US005876323A

United States Patent [19]

Hodge et al.

[11] Patent Number: 5,876,323

[45] Date of Patent: Mar. 2, 1999

[54] HEATED, OPENED ACCESS DOOR FOR INCUBATOR

[75] Inventors: Colin G. Hodge, Columbia; Christopher A. Dykes, Odenton, both of Md.

[73] Assignee: Ohmeda, Inc., Liberty Corner, N.J.

[21] Appl. No.: 864,613

[22] Filed: May 28, 1997

[51] Int. Cl.[6] ..... A61G 11/00

[52] U.S. Cl. ..... 600/22

[58] Field of Search ..... 600/21, 22; 219/385, 219/522, 526, 527, 543, 203, 411, 405, 407

[56] References Cited

U.S. PATENT DOCUMENTS

| | | | |
|---|---|---|---|
| 4,039,775 | 8/1977 | Andra | 219/385 |
| 4,936,824 | 6/1990 | Koch et al. | 600/22 |
| 5,119,467 | 6/1992 | Barsky et al. | 600/22 X |
| 5,498,229 | 3/1996 | Barsky et al. | 600/22 |

*Primary Examiner*—John P. Lacyk
*Assistant Examiner*—Samuel Gilbert
*Attorney, Agent, or Firm*—Roger M. Rathbun

[57] ABSTRACT

An infant incubator having an infant compartment that contains the infant and which is set to a desired temperature above ambient by the user. The incubator has at least one access door that opens to allow the caregiver to perform an intervention on the infant and which is actively heated when in the open position. Thus, when the access door is again closed, the door is at an elevated temperature with respect to the ambient and less heating energy is needed to return the infant compartment back to the desired temperature.

7 Claims, 4 Drawing Sheets

HEATED, OPENED ACCESS DOOR FOR INCUBATOR

BACKGROUND

The present invention relates to infant incubators and, specifically, to an improved incubator having an access door that is heated when in its fully opened position so as to reduce the disruption to the heated environment within the infant compartment when the door is again closed. Infant incubators, in general, provide a unique environment surrounding the infant and create a heated, humidified atmosphere to promote the well-being of the infant contained within the enclosure.

In general, such incubators comprise a base wherein various heating and other air conditioning components are located and which provides the heated, humidified supply of air to an infant compartment that contains the infant.

The infant compartment is normally enclosed by a hood which is transparent so that the caregiver can see the infant and ensure its safety. The temperature within the infant compartment is controlled to be at a set temperature established by the caregiver and it is important to maintain that set temperature constant throughout the time the infant is contained within the infant compartment.

With such infant compartments, however, it is normal to access the infant in order to carry out an intervention, that is to perform some procedure on the infant in furtherance of the care to that infant. At such times, the infant compartment or hood may be provided with one or more doors that allow the caregiver that access to the infant.

In general, the infant compartment has various doors for access to the infant. Generally, there is a relatively large door where total access is needed for the particular intervention and also, there are one or more smaller doors, referred to as handholes, that allow introduction of the arms of the caregiver and are used for lesser interventions and cause less disruption to the internal atmosphere. As used throughout the present description, the term door will be seen to refer to basically any access door to the internal environment of an infant compartment.

Obviously, when any such door is opened, there is an effect on the environment containing the infant since the open door invites the admission of external ambient air which, of course, is not heated and humidified to the extent of the desired atmosphere for the infant. The internal infant compartment environment is thus compromised and heat is lost to the external environment. The amount of heat loss depends, among other factors, on the surface area of the particular door and the amount of time consumed by the intervention. Accordingly, once the particular intervention has been completed and the door closed, the incubator must restore the internal environment of the compartment to the set point temperature as rapidly as possible.

As a further problem with respect to quickly recovering the temperature within the incubator, in general, the doors are swung outwardly and stay in that position until the intervention is completed. Thus the door itself is basically in the surrounding atmosphere which is at ambient temperature and which is lower that the temperature desired within the infant compartment. Whereas the environment within the incubator may be set at, for example, 90–100 degrees F., the ambient in a hospital is more likely to be at about 70 degrees F.

Accordingly, when the door is again shut after completion of the intervention, that door itself can further delay the time needed to bring the infant compartment back up to the desired set temperature since the surface of the door has been reduced to the ambient temperature and that large surface provides a cooling effect on the internal environment when in the closed position. Obviously, the internal atmosphere has been disrupted by having the open portal in the first place, however, the loss of heat is further compounded by returning the now cooled door to the closed position. Normally, when a door is opened, the consequent drop in temperature causes the heater to increase its energy to try to maintain the internal environment at the set temperature. Accordingly, when the door is again closed and is colder than the desired set temperature, the heater has to exert additional energy to maintain the temperature since heat is being lost to the cold door surface.

SUMMARY OF THE INVENTION

The present invention provides an improved incubator having a unique arrangement that provides heat to the door when in its open position, preferable in its fully open position, so that the door does not fall in temperature to the ambient temperature. Accordingly, because the door is heated in the open position, there is less disruption to the internal environmental temperature of the infant compartment when the door is returned to its closed position.

The door may be heated to the internal temperature of the infant compartment or some other elevated temperature above ambient and the heating means may be through circulation of the normal heated air from the incubator that circulates through or over the door when it is opened. Alternatively, the door may have a separate heating means such as a resistance heater and in either instance, the heating is automatic upon opening of the door so that the door is at a elevated temperature above ambient when the door is thereafter closed following an intervention. The temperature within the infant compartment can thus be restored to the desired set point within a lesser period of time.

Other features of the incubator will become more apparent in light of the following detailed description of a preferred embodiment thereof and as illustrated in the accompanying drawings.

DETAILED DESCRIPTION OF THE INVENTION

Figure 1:
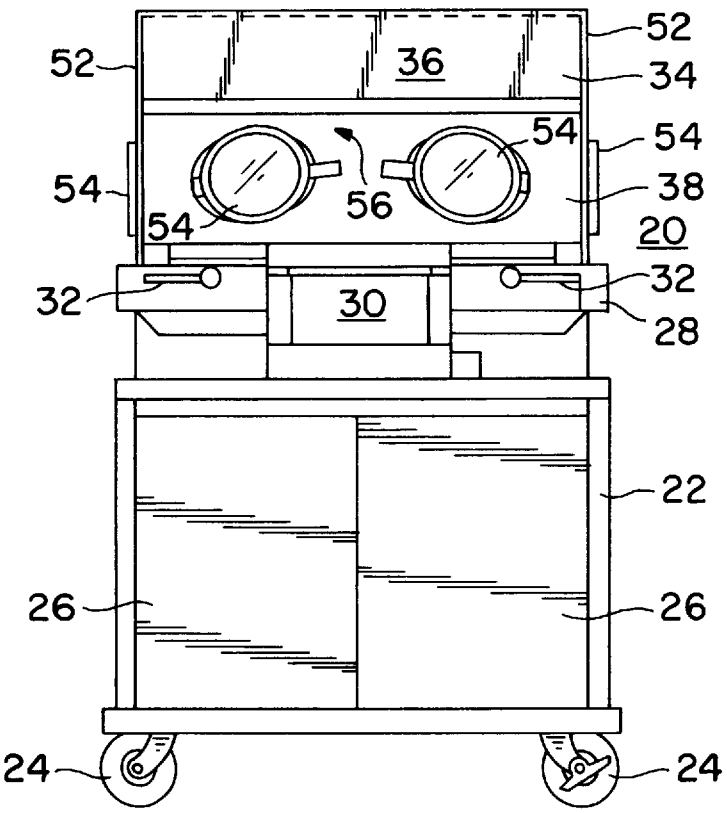
FIG. 1 is front view of an incubator having a heated door constructed in accordance with the present invention.

Referring now to FIG. 1, there is shown an infant incubator 20 mounted upon a base cabinet 22. The base cabinet 22 provides support for infant incubator 20 at the appropriate height and may include wheels 24 so that the infant incubator 20 can be easily moved from one location to another. The base cabinet 22 may contain a storage facility for holding products for attending to infants and, as shown, doors 26 are provided for access to that storage area.

Infant incubator 20 includes a base 28, preferably of a rigid structural material including aluminum or a plastic such as polycarbonate. The base 28 seats upon base cabinet 22 and contains much of the functioning mechanism for operation of the infant incubator 20 as will be later explained.

Base 28 may also include control panel 30 where controls are located for operating the infant incubator 20. Such controls may include temperature settings, temperature readouts, alarm settings and the like. Relevant to this invention is that one of the typical controls is an operator setting of the temperature desired by the caregiver for the atmosphere surrounding the infant. Levers 32 may also be a part of the base 28 and are usable to adjust the tilt position of the infant bed (not shown).

Figure 2:
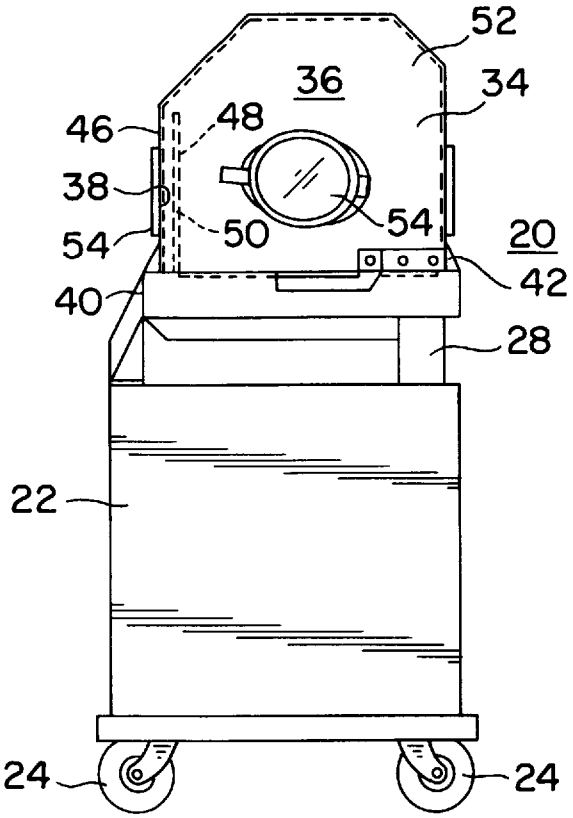
FIG. 2 is a side view of the incubator of FIG. 1.

A hood 34 overlies base 28 and encloses therein an infant compartment 36. As shown in FIGS. 1 and 2, hood 34 is of is of a single wall construction and surrounds the infant compartment 36. Hood 34 is of a transparent material, preferably Plexiglas, and has an access door 38 for the attending personnel to gain ready access to the infant.

As can further be seen in FIG. 2, the access door 38 can be seen to be pivotally connected to base 28 by means such as pins 40 or, other alternative pivoting means could be employed including piano type hinges.

Hood 38 itself may be pivotally connected to the base 28 at the rear of the incubator 20 by means such as pivot 42 such that the entire hood 34 may be opened, yet the access door 38 will not move with hood 34 as hood 34 is opened since access door 38 is affixed to base 28 and not to hood 34.

The access door 38 is preferable of a double wall construction having an outer wall 46 and an inner wall 48, forming an air passage 50 there between. As noted in FIG. 2 specifically, the air passage 50 of access door 38 allows, when in its closed position, a path for warm air to pass through access door 38 and continue around the interior of the hood 34 such that the heated air circulates from the front of infant incubator 20 over and around the infant compartment 36, to the rear of incubator 20 where the air returns to the base 28. The side walls 52 of hood 34 are single walls of transparent material.

Other features of hood 34 include handholes 54 for the attending personnel to have access to the infant without opening any larger openings to the infant compartment 36. A latch 56 is provided for opening and closing access door 38.

Figure 3:
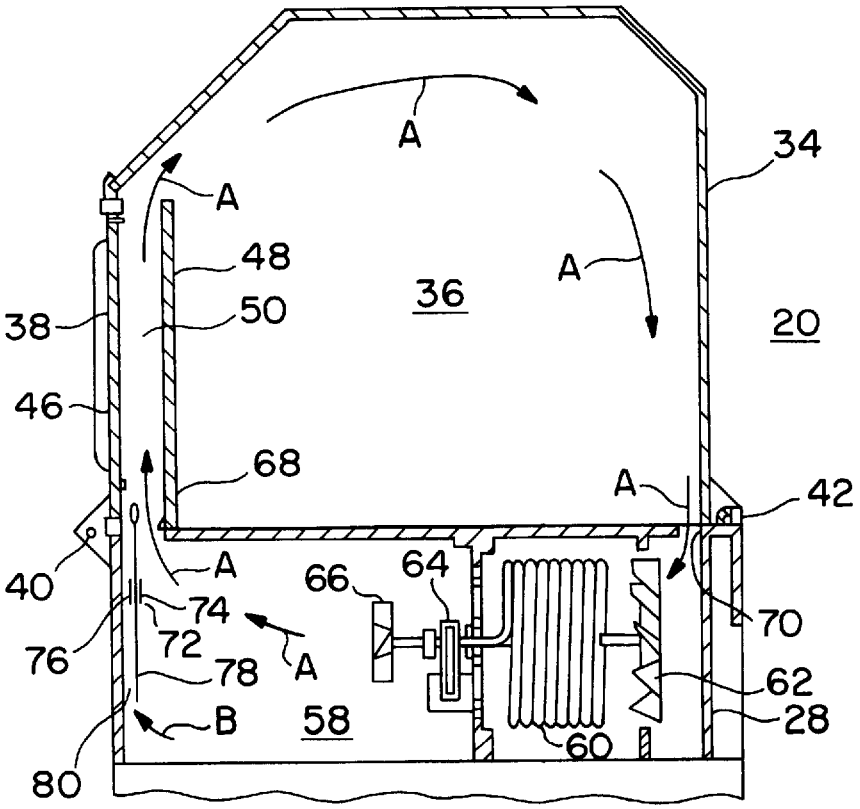
FIG. 3 is a side cross sectional view of an incubator specifically showing the details of the door heating mechanism of the present invention with the door in the closed position.

Turning now to FIG. 3, there is shown a side cross sectional view of an infant incubator 20 and illustrating the access door 38 in the closed position. A heater compartment 58 is contained within the base 28 and contains the means to heat and circulate that heated air through hood 34 to heat infant compartment 36. The actual means to provide such heat and circulation of the heated air may comprise a conventional heater 60 and a fan 62 that induces the air past heater 60 to heat the air which then enters the remaining portion of heater compartment 58. A fan motor 64 with a cooling fan 66 is used to power the fan 62. The heated air that passes from heater 60 is directed toward an outlet opening 68 in the base 28 and through which the heated air passes to enter the air passage 50 formed in access door 38, through the infant compartment 58 to be returned to the heater compartment 58 by inlet opening 70 as depicted by arrows A.

Affixed to the base 28 is also a guide 72 which, as shown, comprises a two parallel strips 72 and 74 of a material such as plastic and which are spaced apart and both of which are affixed to the base by means such as standoffs, (not shown). A gas flow director 78 is positioned between the strips 74 and 76 and is freely movable there between and also may comprise a flexible strip of plastic that extends across the entire front of the infant incubator 20. The gas flow director 78 is affixed at its top to the interior surface of the access door 38, again by means such as standoffs (not shown). As can be seen, a portion of the heated air from the heater 60 enters into a passageway 80 shown by the arrow B and which also thereafter enters the air passage 50 in access door 38 when access door is in the closed position as shown in FIG. 3. A sealing strip 82 may also be located at the top of the access door 38 to provide a seal against the hood 34.

Figure 4:
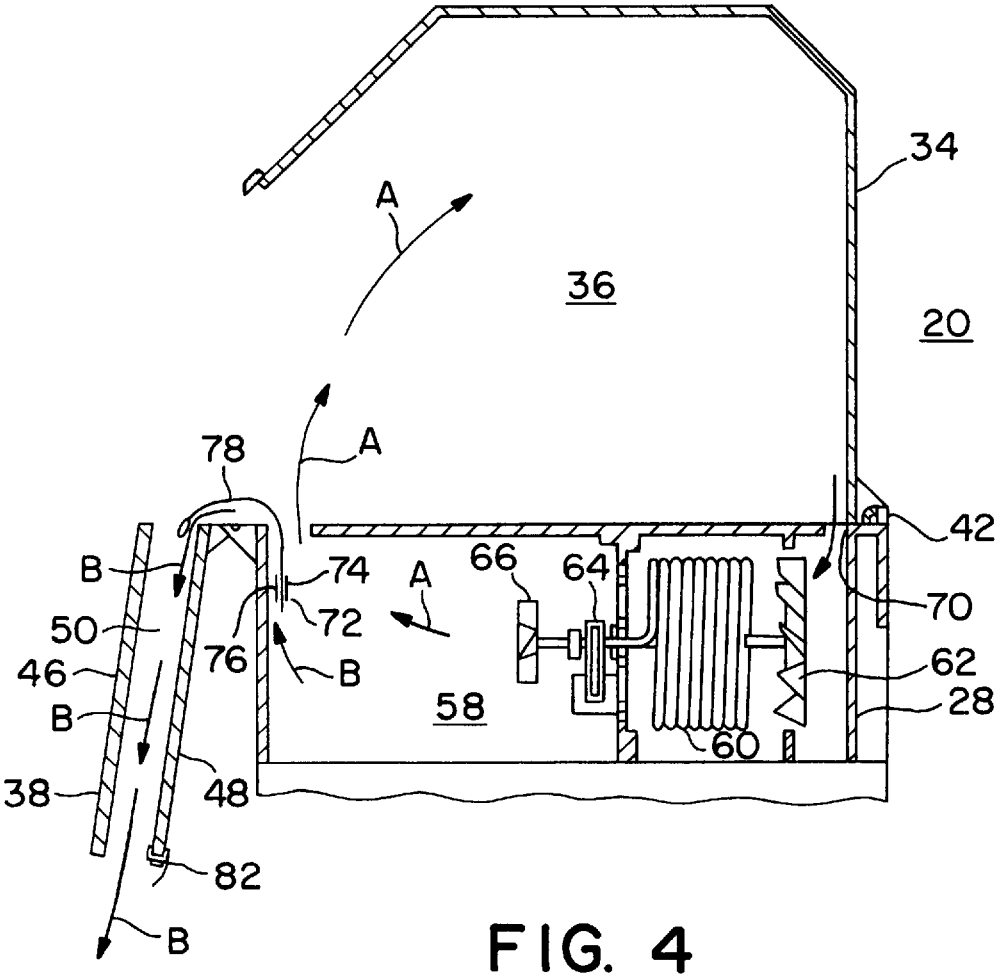
FIG. 4 is a side cross sectional view of the door of FIG. 3 with the door in the open position.

Turning now to FIG. 4, there is shown a side view of the infant incubator 20 of FIG. 3 wherein the access door 38 is in the open position. As can now be seen, a portion of the heated air from the heater 60 continues to enter the passageway 80 but now further continues along that passageway depicted by the arrows B to pass through the air passage 50 in access door 38 even when it is in the open position. In the open position, therefore, there is a continual stream of heated air that passes along the surfaces of the access door 38 and continues to warm that access door 38 by a portion of the heated air that normally would have passed into the incubator compartment 58 if the access door 38 were in the closed position. Accordingly, the heated air serves to maintain the access door 38 at a elevated temperature with respect to the ambient and when the access door 38 is returned to its closed position of FIG. 3 after the completion of a intervention, the access door 38 is not at the cooler ambient temperature but is at an elevated temperature and therefore does not cause as much disruption or delay in bringing the infant compartment 58 back up to the set temperature established by the caregiver.

Figure 5:
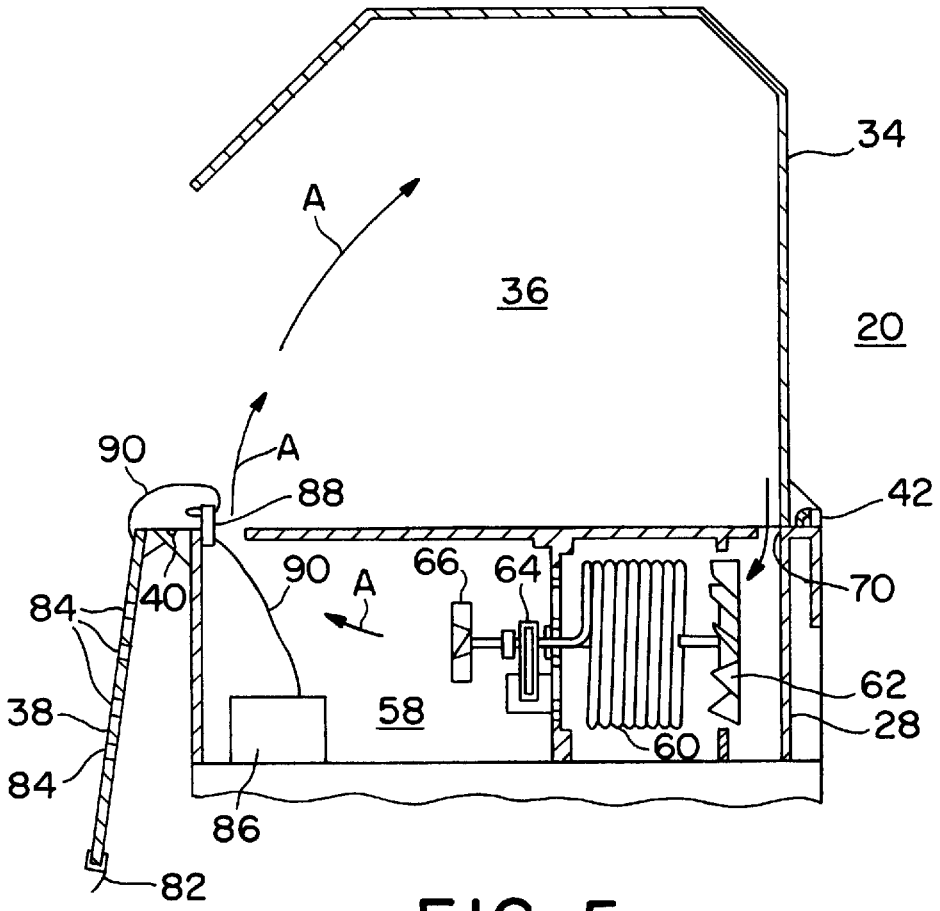
FIG. 5 is a cross sectional view of an alternate heating mechanism for the incubator door.

Turning now to FIG. 5, there is shown a further side cross sectional view of an alternative heating means for the access door 38. In the FIG. 5 embodiment, a high resistance wire 84 is embedded or formed in the access door 38 and which is electrically activated to provide heat to the access door 38. A power supply 86, or transformer, is used to supply the electrical energy to the access door and a switch, such as a micro switch 88 may be used along with conventional wiring 90 to energize the high resistance wire 84*v* whenever the access door 38 is moved to its open position. Accordingly, the access door may be electrically heated to an elevated desired temperature by an electrical heater whenever the door is opened and the electrical heating terminated when the door is again closed.

It will be understood that the scope of this invention is not limited to the particular steps or materials disclosed herein, by way of example, but only by the scope of the appended claims.

We claim:

1. An infant incubator for providing a heated atmosphere to an infant, said incubator comprising an infant compartment adapted to contain an infant, heating means to heat the infant compartment to a desired temperature above the ambient temperature surrounding said incubator, said heating means comprising a heater within said incubator and means to circulate air past said heater to hear said air and to introduce said heated air into said infant compartment to heat said infant compartment, said infant compartment having an access door movable between a closed position and an open position allowing access to an infant within said infant compartment, and means to heat said access door when in said open position to a temperature above the ambient temperature, said means to heat said access door comprising means to divert a portion of said heated air across said open access door.

2. An infant incubator as defined in claim 1 wherein said access door comprises a double walled door having an air passage formed between said walls and said means to divert a portion of said heated air directs said heated air through said passageway.

3. An infant incubator for providing a heated atmosphere to an infant, said infant incubator comprising:

a base section having an infant support adapted to underlie an infant, a hood mounted to said base section, said hood adapted to form an infant compartment with said base, an access door in said hood, said access door being pivotally mounted to said base section and movable between a closed position enclosing the infant compartment and an open position allowing access to the infant compartment, heating and air ducting means in said base section for forcing heated air from said base section into said infant compartment at a temperature above the ambient temperature surrounding said incubator, air directing means for directing heated air from said base section to across said access door when said access door is in said open position to heat said access door to a temperature above the ambient temperature.

4. An infant incubator as defined in claim 3 wherein said air directing means diverts a portion of the heated air normally forced into said infant compartment to heat said access door when in said open position.

5. An infant incubator as defined in claim 4 wherein said access door comprises two spaced walls forming an air passage there between and said air directing means diverts said portion of the heated air through said air passage.

6. A method of maintaining the heated environment within an infant compartment of an incubator having a door movable between open and closed positions, said method comprising:

opening the door to the open position to obtain access to an infant within the infant compartment, and heating the door while the door is in the open position to a temperature above the ambient temperature.

7. An infant incubator for providing a heated atmosphere to an infant, said incubator comprising an infant compartment adapted to contain an infant, heating means to heat the infant compartment to a desired temperature above the ambient temperature surrounding said incubator, said infant compartment having an access door movable between a closed position and an open position allowing access to an infant within said infant compartment, an electrical heating means to heat said access door when in said open position to a temperature above the ambient temperature, said electrical heating means further comprises a switch means operable by the opening of said access door to provide electrical energy to said electric heater.

* * * * *